United States Patent [19]

Lüthi

[11] 4,331,000

[45] May 25, 1982

[54] APPARATUS FOR COOLING HEATED THERMOPLASTICS YARNS

[75] Inventor: Walter Lüthi, Ebnat Kappel, Switzerland

[73] Assignee: Heberlein Maschinenfabrik AG, Wattwil, Switzerland

[21] Appl. No.: 197,207

[22] Filed: Oct. 15, 1980

[30] Foreign Application Priority Data

Oct. 15, 1979 [CH] Switzerland ..... 9256/79

[51] Int. Cl.[3] ..... F25D 17/02

[52] U.S. Cl. ..... 62/374; 34/155; 57/284; 62/381; 134/64 R; 134/122 R

[58] Field of Search ..... 62/63, 64, 381, 374, 62/375; 34/16, 23, 147, 155; 134/64 R, 122 R; 57/284

[56] References Cited

U.S. PATENT DOCUMENTS 2,990,670 7/1961 Kingsbury ..... 57/284

4,040,269 8/1977 Nordblad et al. ..... 62/374

*Primary Examiner*—Ronald C. Capossela

*Attorney, Agent, or Firm*—Young & Thompson

[57] ABSTRACT

The yarn cooling apparatus comprises an inner tube through which passes a liquid coolant, e.g. water, and in which there is disposed a coaxial cylinder having a spiral peripheral groove of wedge-shaped cross-section along which the yarn travels. Provided at the yarn outlet end of the coolant tube is a supporting member which has a fixed part with a groove of U-shaped cross-section through which the yarn travels and which extends in the direction of the axis of the coolant-carrying tube, and a movable part provided with air and coolant passages arranged to cover and uncover the groove, according to its position.

6 Claims, 3 Drawing Figures

APPARATUS FOR COOLING HEATED THERMOPLASTICS YARNS

The invention relates to apparatus for cooling heated textile yarns produced from thermoplastics materials.

Methods and apparatus are already known for texturising thermoplastics textile yarns by a false-twist procedure, in which the highly twisted yarn is transformed by heating into a thermoplastic condition, after which cooling of the yarn causes rehardening and thus the twist is fixed. The heating can be carried out for example by contact with a hot surface, and cooling as a rule occurs during travel of the yarn through an air space at room temperature.

It has however been found that at relatively high speeds of yarn travel this air space must be relatively long to achieve adequate cooling, so that in cases where it is necessary to keep the cooling path as short as possible very intensive cooling must be applied using special cooling apparatus adjacent to the heating apparatus.

Existing cooling apparatus for this purpose has the disadvantage that the cooling effect obtainable is still not sufficiently intensive for very high yarn speeds, such as have become possible with modern highspeed false-twisting apparatus.

Accordingly it is an object of the present invention to reduce or eliminate these disadvantages, and to provide improved cooling efficiency so that the length of the cooling path can be minimised, and thus the space required by the texturising machine reduced.

Broadly stated the invention consists in apparatus for cooling heated textile yarn formed of thermoplastics material, comprising an inner coolant tube through which the yarn travels and through which a liquid cooling medium flows, an outer tube surrounding and spaced from the inner tube, and a supporting member at the yarn inlet end of the inner tube, having a yarn passage, coolant supply and discharge passages, and an air supply passage, and including a cylinder with a spiral peripheral yarn groove positioned coaxially within the inner tube, and in which the supporting member has a fixed part with a groove along which the yarn passes extending in the direction of the axis of the inner coolant tube, and also has a movable part provided with air and coolant passages and arranged to cover or uncover the yarn groove according to its position.

The groove in the fixed part of the supporting member may preferably have a diameter and a depth of 0.5 to 1 mm. The fixed part of the supporting member may be constructed as a hollow cylinder, the groove extending along a generatrix on the inner wall of the cylinder and the movable part of the supporting member may be a cylindrical pin rotatable about its axis and inserted into a bore in the hollow cylinder. Furthermore, the movable part of the supporting member may have, movable in front of the groove in the fixed part of the supporting member, a groove the dimensions of which are a multiple of those of the groove in the fixed part of the supporting member.

The cooling apparatus according to the invention produces a transfer of heat which exceeds by many times the transfer of heat which can be achieved with air cooling.

The invention may be performed in various ways and one specific embodiment with some possible modifications, will now be described by way of example with reference to the accompanying drawings, in which.

Figure 1:
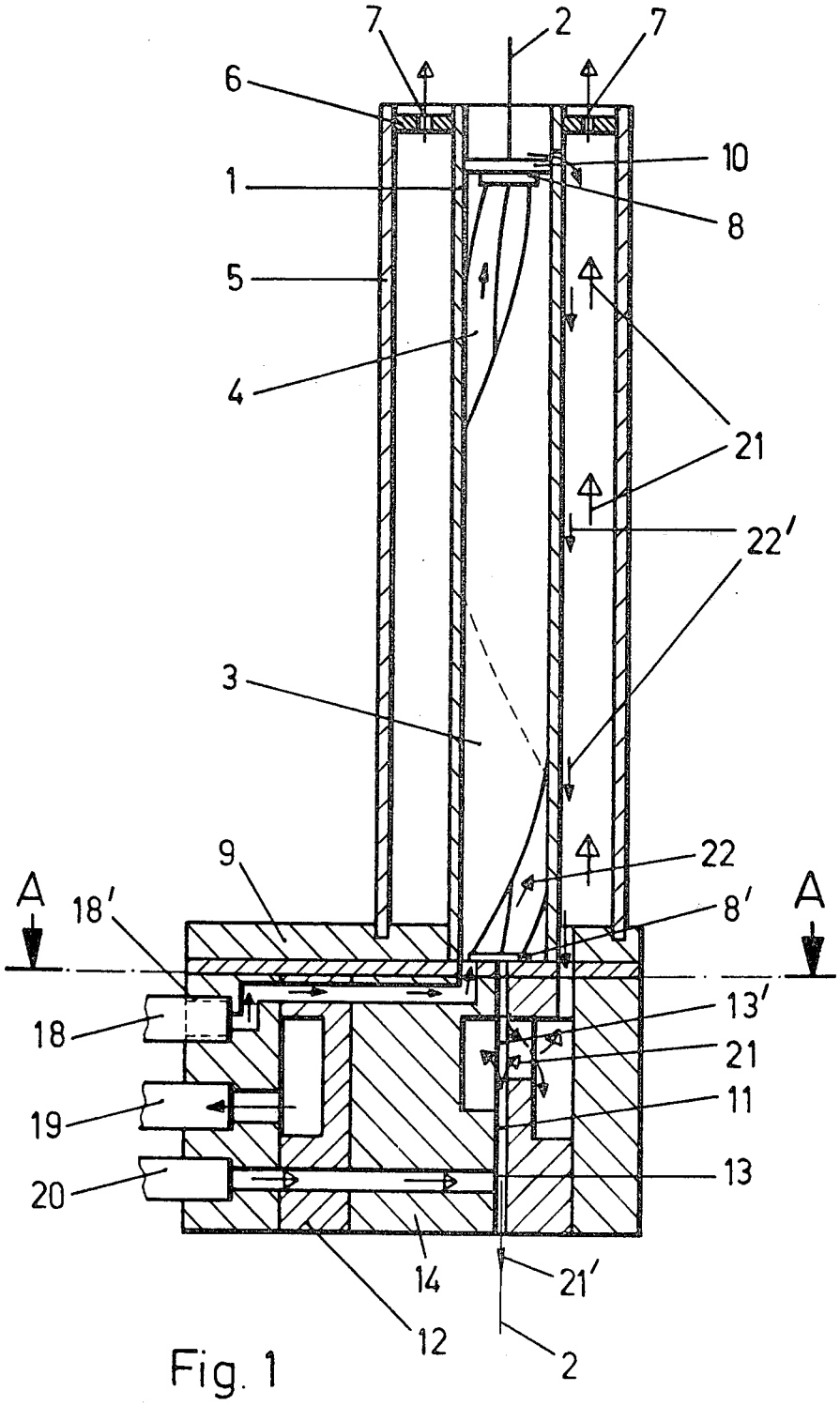
FIG. 1 is a somewhat diagrammatic longitudinal section through a yarn cooling apparatus according to the invention.
Figure 2:
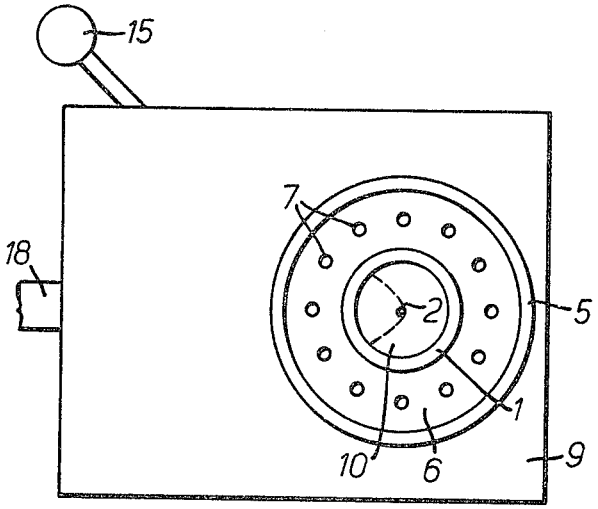
FIG. 2 is a plan view of the apparatus.

As seen in FIG. 1, the apparatus comprises an inner vertical coolant-carrying tube 1 in which there is disposed a cylinder 3 coaxial with the coolant-carrying tube and provided with a spiral peripheral groove 4. The groove 4 has a wedge-shaped cross-section and a heated false-twist yarn 2, to which tension is applied constantly from above and below, travels at high speed along the groove 4. The coolant-carrying tube 1 is surrounded by an outer tube 5 of larger diameter, which is provided at the yarn outlet end with a cover 6 having an aperture to allow passage of the coolant-carrying tube 1 and a number of air outlet orifices 7, as seen in FIG. 2. At each of the two ends of the cylinder 3 there is a disc-shaped thread guide 8, 8', conveniently of sapphire, the said disc-shaped thread guides having wedge-shaped notches corresponding to the groove 4. Furthermore, a cover disc 10 is positioned on the thread guide 8.

The lower yarn inlet end of the coolant-carrying tube 1 and of the outer tube 5 are attached to a supporting member 9 which has a part 12 in the form of a hollow cylinder rigidly connected to the supporting member. Extending along a generatrix on the inner wall of the cylinder is a U-shaped groove 11, having a diameter and depth of approximately 0.5 and 1 mm. The groove 11 is interrupted at two places by coolant and air through-flow apertures 13, 13' in the part 12. Inserted into the bore in the hollow cylindrical part 12 is a cylindrical pin 14 which can be rotated about its axis by means of a lever 15, between two stops 17, 17'.

Figure 3:
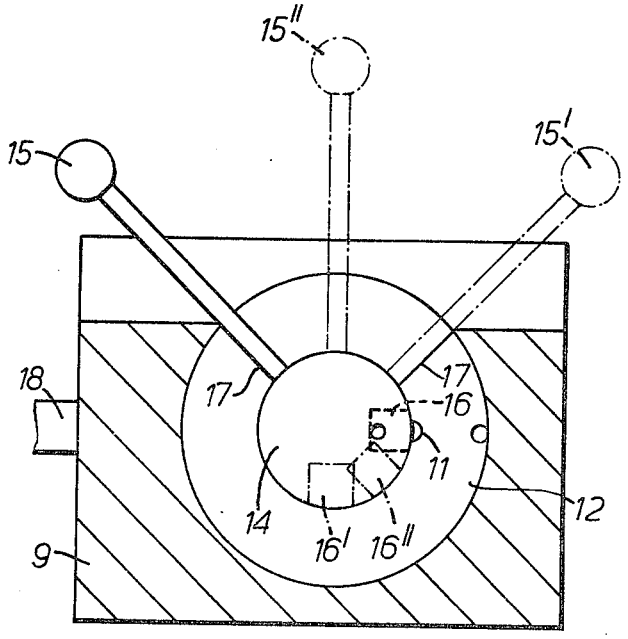
FIG. 3 is a cross-section on the line A—A in FIG. 1.

As can be seen from FIG. 3, the cylindrical pin 14 has, extending parallel with its axis, a groove 16 of square cross-section, with a side length of 5 mm. By shifting the lever 15 as far as the stop 17, the groove 16 can be moved across in front of the groove 11 in the part 12 to create a sufficiently large aperture for introduction of a conventional yarn threading spring. In this position of the cylindrical pin 14, the coolant supply passage 18 and air supply passage 20 provided in the supporting member 9 are closed and the coolant discharge passage 19 is open.

If the lever 15 is rotated as far as the other stop 17', into position 15', then the groove in the cylindrical pin 14 lies in the position 16', and at the same time the coolant supply passage 18 and the air supply passage 20 are opened. If the lever 15 is moved in the position 15'' so that the cylindrical pin groove is moved into the position 16'', then the coolant supply passage 18 is closed and the coolant discharge passage 19 and the air supply passage 20 are opened.

When the yarn 2 is to be drawn into the apparatus described, firstly the lever 15 is rotated into the starting position as far as the stop 17 and the yarn is, by means of a conventional threading spring, drawn through the spiral peripheral groove 4 and the groove 16 in the cylindrical pin 14, after which it is led on into the subsequent parts of the machine (not illustrated). Thereupon, the machine is started and as soon as it has reached full speed, the lever 15 is moved into the position 15'. Air from a compressed air source (not shown) then flows through the passage 20 and in the direction of arrows 21, 21' through the groove 11, emerging partly through the lower end thereof and partly through the outer tube 5 and the orifices 7 in the top cover 6.

The next step is to cause water, serving as a coolant, to flow through the passage 18 which is provided with a water flow restricting means 18'. The coolant rises in the direction of the arrows 22 in the spiral peripheral groove 4, and passes over the edge of the cover disc 10 to an opening (not shown) in the tube 1, after which it flows downwardly inside the outer tube 5 and is discharged through the passage 19. It is possible to observe the flow of coolant at the cover disc 10. In the event of thread breakage or immobilisation of the machine, firstly the lever 15 is moved into the position 15'', i.e. the coolant supply is cut off. Finally, the lever 15 is moved again into the starting position so that the passages 18, 20 are again closed.

The cylinder 3 with the spiral peripheral groove 4 is a very important component part of the apparatus since it provides for improved yarn guidance through the coolant tube 1 and formation of a balloon of thread can usually be prevented. As a result it is possible to avoid turbulence causing unacceptable large amounts of air to be drawn into the water, which would substantially diminish the cooling action and render it unstable. Furthermore, if the cylinder 3 with the spiral peripheral groove 4 is disposed in the coolant-carrying tube 1, less coolant is required and the coolant can, if necessary, also be removed quickly.

I claim:

1. Apparatus for cooling heated textile yarn formed of thermoplastics material, comprising an inner coolant tube, a cylinder with a spiral peripheral yarn groove positioned coaxially within said inner tube, means for guiding the yarn to travel along said groove, means for passing a coolant fluid along said groove, an outer tube surrounding and spaced from the inner tube, and a supporting member at the yarn inlet end of the inner tube, including a control valve having coolant supply and discharge passages, and an air supply passage, and a yarn threading groove along which the yarn passes, extending in the direction of the axis of the inner coolant tube, the valve being arranged to cover or uncover the yarn groove according to its position.

2. Apparatus according to claim 1, in which the said control valve has a fixed part with a yarn threading groove which has a diameter and depth of 0.5 to 1 mm.

3. Apparatus according to claim 1, in which the valve has a fixed part in the form of a hollow cylinder, with said yarn threading groove extending along a generatrix on the inside wall of the cylinder, and a movable part in the form of a cylindrical pin inserted into the bore in the hollow cylinder and rotatable therein about its axis.

4. Apparatus according to claim 1 in which valve has a movable part formed with the yarn threading groove, which is movable into a position aligned with a groove in a corresponding fixed part of the valve.

5. Apparatus according to claim 4 in which the dimensions of the groove in the movable part are greater than or a multiple of those of the groove in the fixed part of the supporting member.

6. Apparatus according to claim 1, in which the spiral peripheral groove in the cylinder positioned within the inner coolant tube is of wedge-shaped cross-section.

* * * * *